US006899146B2

(12) United States Patent
Bingham et al.

(10) Patent No.: US 6,899,146 B2
(45) Date of Patent: May 31, 2005

(54) METHOD AND APPARATUS FOR DISPENSING COMPRESSED NATURAL GAS AND LIQUIFIED NATURAL GAS TO NATURAL GAS POWERED VEHICLES

(75) Inventors: Dennis A. Bingham, Idaho Falls, ID (US); Michael L. Clark, Menan, ID (US); Bruce M. Wilding, Idaho Falls, ID (US); Gary L. Palmer, Shelley, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 50 days.

(21) Appl. No.: 10/435,166

(22) Filed: May 9, 2003

(65) Prior Publication Data

US 2004/0250871 A1 Dec. 16, 2004

(51) Int. Cl.[7] ..... B65B 1/20

(52) U.S. Cl. ..... 141/11; 141/82; 141/4; 62/50.2

(58) Field of Search ..... 141/1, 2, 4, 5, 141/11, 18, 82; 62/50.1, 50.2

(56) References Cited

U.S. PATENT DOCUMENTS

| | | | |
|---|---|---|---|
| 1,419,880 | A | 6/1922 | Mauclere |
| 2,028,119 | A | 1/1936 | Boshkoff |
| 2,252,830 | A | 8/1941 | Bliss et al. |
| 2,286,050 | A | 6/1942 | Baker et al. |
| 2,443,724 | A | 6/1948 | Cibulka |
| 2,551,501 | A | 5/1951 | Mitchell et al. |
| 2,732,103 | A | 1/1956 | Wright et al. |
| 2,964,917 | A | 12/1960 | Webster |
| 2,970,452 | A | 2/1961 | Beckman et al. |
| 3,272,238 | A | 9/1966 | Groppe |
| 3,407,616 | A | 10/1968 | Freeman, Jr. |
| 3,479,832 | A | 11/1969 | Sarsten et al. |
| 3,578,753 | A | 5/1971 | Freeman, Jr. |
| 3,720,057 | A | 3/1973 | Arenson |
| 3,837,172 | A | 9/1974 | Markbreiter et al. |

(Continued)

FOREIGN PATENT DOCUMENTS

| | | | |
|---|---|---|---|
| JP | 55-142198 | A | 11/1980 |
| JP | 56-116996 | A | 9/1981 |
| JP | 56-120895 | A | 9/1981 |
| JP | 57-065792 | A | 4/1982 |
| JP | 57-149699 | A | 9/1982 |
| JP | 61-016991 | A | 1/1986 |
| JP | 01-091543 | A | 4/1989 |
| JP | 04-316795 | A | 11/1992 |
| JP | 10-274395 | A | 10/1998 |
| SU | 1095012 | A | 5/1984 |

OTHER PUBLICATIONS

Koch, Wolf H., LNG Technology Trends, Natural Gas Fuels, Aug. 1997, pp. 18, 18a, 19.

(Continued)

*Primary Examiner*—Timothy L. Maust
(74) *Attorney, Agent, or Firm*—Trask Britt PC

(57) ABSTRACT

A fueling facility and method for dispensing liquid natural gas (LNG), compressed natural gas (CNG) or both on-demand. The fueling facility may include a source of LNG, such as cryogenic storage vessel. A low volume high pressure pump is coupled to the source of LNG to produce a stream of pressurized LNG. The stream of pressurized LNG may be selectively directed through an LNG flow path or to a CNG flow path which includes a vaporizer configured to produce CNG from the pressurized LNG. A portion of the CNG may be drawn from the CNG flow path and introduced into the CNG flow path to control the temperature of LNG flowing therethrough. Similarly, a portion of the LNG may be drawn from the LNG flow path and introduced into the CNG flow path to control the temperature of CNG flowing therethrough.

31 Claims, 7 Drawing Sheets

U.S. PATENT DOCUMENTS

| | | | | |
|---|---|---|---|---|
| 3,898,853 | A | 8/1975 | Lung | |
| 3,962,882 | A | 6/1976 | Gee et al. | |
| 3,986,340 | A | 10/1976 | Bivins, Jr. | |
| 4,055,050 | A | 10/1977 | Kozlov | |
| 4,299,091 | A | 11/1981 | Carter et al. | |
| 4,321,796 | A | 3/1982 | Kohno | |
| 4,376,376 | A | 3/1983 | Gregory | |
| 4,406,129 | A | 9/1983 | Mills | |
| 4,494,415 | A | 1/1985 | Elliston | |
| 4,646,940 | A | 3/1987 | Kramer et al. | |
| 4,680,937 | A | 7/1987 | Young | |
| 4,738,115 | A | 4/1988 | Goode | |
| 4,749,384 | A | 6/1988 | Nowobilski et al. | |
| 4,751,822 | A | 6/1988 | Viard | |
| 4,778,498 | A | 10/1988 | Hanson et al. | |
| 4,838,034 | A | 6/1989 | Leonard et al. | |
| 4,898,217 | A | 2/1990 | Corbo et al. | |
| 4,987,932 | A | 1/1991 | Pierson | |
| 5,107,906 | A | 4/1992 | Swenson et al. | |
| 5,121,609 | A | 6/1992 | Cieslukowski | |
| 5,127,230 | A | 7/1992 | Neeser et al. | |
| 5,147,005 | A | 9/1992 | Haeggstrom | |
| 5,163,409 | A | 11/1992 | Gustafson et al. | |
| 5,228,295 | A | 7/1993 | Gustafson | |
| 5,263,826 | A | 11/1993 | Baumann et al. | |
| 5,301,723 | A | 4/1994 | Goode | |
| 5,309,990 | A | 5/1994 | Lance | |
| 5,315,831 | A | 5/1994 | Goode et al. | |
| 5,360,139 | A | 11/1994 | Goode | |
| 5,370,159 | A | 12/1994 | Price | |
| 5,373,702 | A | 12/1994 | Kalet et al. | |
| 5,385,176 | A | 1/1995 | Price | |
| 5,409,046 | A | 4/1995 | Swenson et al. | |
| 5,441,234 | A | 8/1995 | White et al. | |
| 5,465,583 | A | 11/1995 | Goode | |
| 5,477,690 | A | 12/1995 | Gram | |
| 5,505,232 | A | 4/1996 | Barclay | |
| 5,512,787 | A | 4/1996 | Dederick | |
| 5,549,142 | A | 8/1996 | Beale | |
| 5,551,488 | A | 9/1996 | Gram | |
| 5,566,712 | A | 10/1996 | White et al. | |
| 5,641,005 | A | 6/1997 | Kountz et al. | |
| 5,682,750 | A | 11/1997 | Preston et al. | |
| 5,699,839 | A | 12/1997 | Dehne | |
| 5,884,488 | A | 3/1999 | Gram et al. | |
| 5,887,567 | A | 3/1999 | White et al. | |
| 6,058,713 | A | 5/2000 | Bowen et al. | |
| 6,474,101 | B1 * | 11/2002 | Quine et al. | 62/657 |

OTHER PUBLICATIONS

Beale, J., "The 'One–Stop' Fueling Station," CH–IV Cryogenics, 5 pages, 1996, http://www.ch–iv.com/cryo/ngvc96.htm.

Beale, J., "Using LNG to Make CNG," CH–IV Cryogenics, 2 pages, first published in the Natural Gas Fuels Magazine "Cold Corner" column, Apr. 1993, http://www.ch–iv.com/lng/cc9304.htm.

Brookhaven National Laboratory, "BNL Picks Four Companies to Develop Natural Gas Fuel Technologies for Trucks & SUV's," #98–35, 2 pages, Apr. 3, 1998.

California Energy Commission, Consultant Report, "Evaluation of Compressed Natural Gas (CNG) Fueling Systems," pp. 1–65, Oct. 4, 1999.

California Energy Commission, Consultant Report, "Demonstration of LNG Heavy Duty Semi–Tractors Equipped with Upgraded DDC Series 60G Engines," pp. 1–1 through 4–3, Apr. 2002.

California Natural Gas Vehicle Partnership, "Supporting the Expansion of NGVs," no date, http://www.cngvp.org/progress_infrastr.html.

CH–IV International, LNG, CNG, NGV Papers and Presentations by CH–IV Personnel, Oct. 27, 2003. http://www.ch–iv.com/lng/papers1.htm.

Chiyoda Kikai Works, "The Development of L–C.N.G. Charging Systems," 2 pages, 2002, http://www.chiyodakikai.co.jp/en/lcng.html.

Clean Cities National Conference and Expo, 18 pages, May 20, 2003.

Cryogenic Society of America, Inc., "LNG: Fuel of the Future," Cold Facts, The Quarterly Magazine of the Cryogenic Society of America, 7 pages, Summer '96, http://www.cryogenicsociety.org/csa_bind/back_issues/summer96/summer96_2.html.

FleetStar Locations, 1 page, no date, http://www.altlngusa.com/Fleetstar/fleetstar_loc.htm.

Gas Technology Institute, IWG Program Summary, 9 pages, no date.

Cold Corner Column, including Hydra Rig LNG/CNG Systems Division Advertisement, Natural Gas Fuels, p. 33, Nov. 1993.

Hydra Rig. LNG/CNG Systems Division, LNG/CNG Facilities and Equipment, 15 pages, Jan. 1, 1991.

Hydra Rig. Drawing for LNG/CNG Refueling Station, May 18, 1993.

International Association of Natural Gas Vehicles, NGV 2002 Papers, 4 pages, 2002, http://www.iangv.org/jaytech/default.php?PageID=42.

Naturgass i transportsektoren, 21 pages, Sep. 2002.

Sharke, P., "A Diminutive LNG Plant," Mechanical Engineering–CIME. vol. 126: Issue 1; ISSN: 00256501, 1 page, Jan. 1, 2004.

U.S. Dept. of Energy, Sun Metro LNG/CNG Fueling Center, LNG Posting for 1991–1993, 1 page, no date, http://www.ott.doe.gov/pdfs/summetro.pdf.

U.S. Dept. of Energy, Sun Metro—6.2 Million Miles on Natural Gas, 6 pages, May 1997.

U.S. Dept. of Energy, Industry Teams with INEEL to Provide Alternative Fueling Station, DOE News Release, 2 pages, Dec. 18, 2000, http://newsdesk.inel.gov/press_releases/2000/Industry_Teams.htm.

U.S. Dept. of Energy, Natural Gas Vehicle Systems Program, 6 pages, no date, http://www.bnl.gov/est/bnllng.htm.

Yoneza Wa, M., Chiyoda Kikai Works, "Development of L–CNG Refueling System," pp. 1–10, no date.

* cited by examiner

METHOD AND APPARATUS FOR DISPENSING COMPRESSED NATURAL GAS AND LIQUIFIED NATURAL GAS TO NATURAL GAS POWERED VEHICLES

The United States Government has certain rights in this invention pursuant to Contract No. DE-AC07-99ID13727, and Contract No. DE-AC07-05ID14517 between the United States Department of Energy and Battelle Energy Alliance, LLC.

BACKGROUND OF THE INVENTION

1. Field of the Invention

The present invention relates generally to fueling stations for dispensing natural gas to vehicles and, more particularly, to fueling stations having the capacity to provide and dispense both compressed natural gas (CNG) and liquified natural gas (LNG) on-demand.

2. State of the Art

Natural gas is a known alternative to combustion fuels such as gasoline and diesel. Much effort has gone into the development of natural gas as an alternative combustion fuel in order to combat various drawbacks of gasoline and diesel including production costs and the subsequent emissions created by the use thereof. As is known in the art, natural gas is a cleaner burning fuel than many other combustion fuels. Additionally, natural gas is considered to be safer than gasoline or diesel since natural gas rises in the air and dissipates, rather than settling as do other combustion fuels. However, various obstacles remain which have inhibited the widespread acceptance of natural gas as a combustion fuel for use in motor vehicles.

To be used as an alternative combustion fuel, natural gas is conventionally converted into compressed natural gas (CNG) or liquified (or liquid) natural gas (LNG) for purposes of storing and transporting the fuel prior to its use. In addition to the process of converting natural gas to CNG or LNG, additional facilities and processes are often required for the intermediate storage of, and the ultimate dispensing of, the natural gas to a motor vehicle which will burn the natural gas in a combustion process.

Conventional natural gas refueling facilities are currently prohibitively expensive to build and operate as compared to conventional fueling facilities. For example, it is presently estimated that a conventional LNG refueling station costs approximately $350,000 to $1,000,000 to construct while the cost of a comparable gasoline fueling station costs approximately $50,000 to $150,000. One of the reasons for the extreme cost difference is the cost of specialized equipment used in handling, conditioning and storing LNG which is conventionally stored as a cryogenic liquid methane at a temperature of about −130° C. to −160° C. (−200° F. to −250° F.) and at a pressure of about 25 to 135 pounds per square inch absolute (psia).

An additional problem inhibiting the widespread acceptance of natural gas as a combustion fuel for motor vehicles is that, currently, some motor vehicles which have been adapted for combustion of natural gas require CNG while others require LNG thus requiring different types of fueling facilities for each. For example, LNG facilities conventionally dispense natural gas from storage tanks wherein the natural gas is already conditioned and converted to LNG. The LNG is often conventionally delivered to the storage tanks by way of tanker trucks or similar means. On the other hand, CNG facilities often draw natural gas from a pipeline or similar supply, condition the natural gas and then compress it to produce the desired end product of CNG.

Some efforts have been made to provide LNG and CNG from a single facility. For example, U.S. Pat. No. 5,505,232 to Barclay, issued Apr. 9, 1996 is directed to an integrated refueling system which produces and supplies both LNG and CNG. The disclosed system is stated to operate on a small scale producing approximately 1,000 gallons a day of liquefied or compressed fuel product. The Barclay patent teaches that a natural gas supply be subjected to passage through a regenerative purifier, so as to remove various constituents in the gas such as carbon dioxide, water, heavy hydrocarbons and odorants prior to processing the natural gas and producing either LNG or CNG. Thus, as with conventional CNG facilities, it appears that the system disclosed in the Barclay patent requires location in close proximity to a natural gas pipeline or similar feed source.

Additionally, the system disclosed in the Barclay patent requires the natural gas to be processed through a liquefier regardless of whether it is desired to produce LNG or CNG. The requirement of an on-site liquefier may unnecessarily increase the complexity and cost of constructing a natural gas refueling facility, thus keeping the facility from being a realistic alternative to a conventional gasoline fueling facility.

Another example of a combined LNG and CNG fueling facility is disclosed in U.S. Pat. No. 5,315,831 to Goode et al, issued May 31, 1994. The Goode patent discloses a fueling facility which includes a volume of LNG stored in a cryogenic tank. LNG is drawn from the storage tank and dispensed to vehicles as required. CNG is produced by drawing off a volume of the LNG from the storage tank and flowing the LNG through a high-efficiency pump and a vaporizer system, which CNG is then dispensed to a vehicle as required.

While the Goode and Barclay patents disclose integrated fueling stations which purportedly provide the capability of dispensing LNG and/or CNG, improvements to such facilities are still desired in order to make such fueling facilities efficient, practical and comparable in costs of construction and operation relative to conventional gasoline fueling facilities.

In view of the shortcomings in the art, it would be advantageous to provide an integrated fueling system which is able to dispense LNG, CNG or both on demand and which is of simple construction, provides simple, efficient operation and otherwise improves upon the current state of the art.

BRIEF SUMMARY OF THE INVENTION

In accordance with one aspect of the present invention a fueling station is provided. The fueling station includes at least one pump configured to boost a pressure of a volume of liquefied natural gas (LNG) supplied thereto including at least one pressurized output configured to supply pressurized LNG. At least one diverter valve is operably coupled to the at least one pressurized output of the at least one pump, wherein the at least one diverter valve is configured to selectively divert the flow of any pressurized LNG flowing from the at least one pressurized output of the at least one pump between a first flow path and a second flow path. At least one LNG dispensing unit is in fluid communication with the first flow path. A vaporizer is in fluid communication with the second flow path. The vaporizer is configured to receive and convert pressurized LNG to compressed natural gas (CNG). At least one CNG dispensing unit in fluid communication with the vaporizer.

In accordance with another aspect of the invention another fueling station is provided. The fueling station includes a multiplex pump configured to boost the pressure of volume of liquified natural gas (LNG) supplied thereto. The multiplex pump includes at least two pistons wherein each piston has an individual pressurized output configured to provide a supply of pressurized LNG. At least one LNG dispensing unit is disposed in selective fluid communication with the pressurized output of each of the at least two pistons of the multiplex pump. A vaporizer, configured to receive and convert LNG to compressed natural gas (CNG), is placed in selective fluid communication with the pressurized output of each of the at least two pistons of the multiplex pump. At least CNG dispensing unit in is disposed in fluid communication with the vaporizer.

In accordance with another aspect of the present invention a natural gas fueling facility is provided. The fueling facility includes a source of saturated liquified natural gas (LNG) such as a cryogenic storage tank containing a volume of saturated natural gas. The fueling facility further comprises at least one fueling station. The fueling station includes a multiplex pump in fluid communication with the source of saturated LNG. The multiplex pump includes at least two pistons wherein each piston has an individual pressurized output configured to provide a supply of pressurized LNG. At least one LNG dispensing unit is disposed in selective fluid communication with the pressurized output of each of the at least two pistons of the multiplex pump. A vaporizer, configured to receive and convert LNG to compressed natural gas (CNG), is placed in selective fluid communication with the pressurized output of each of the at least two pistons of the multiplex pump. At least CNG dispensing unit is disposed in fluid communication with the vaporizer.

In accordance with a further aspect of the present invention, a method is provided for dispensing natural gas fuel. The method includes providing a supply of saturated liquified natural gas (LNG) at a first pressure to a pump. The saturated LNG is passed through a pump to increasing the pressure of the saturated LNG to a second elevated pressure. A first flow path is provided between the pump and an LNG dispensing unit. A second flow path is provided between the pump and a compressed natural (CNG) dispensing unit. LNG is selectively passed through the first flow path, the second flow path or through both the first and the second flow paths. The pressure of any LNG flowing through the first flow path is reduced to an intermediate pressure, at least a portion of which reduced pressure LNG is subsequently dispensed through the LNG dispensing unit. Any LNG flowing through the second flow path is vaporized to produce CNG therefrom, at least a portion of which CNG is dispensed through the CNG dispensing unit.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
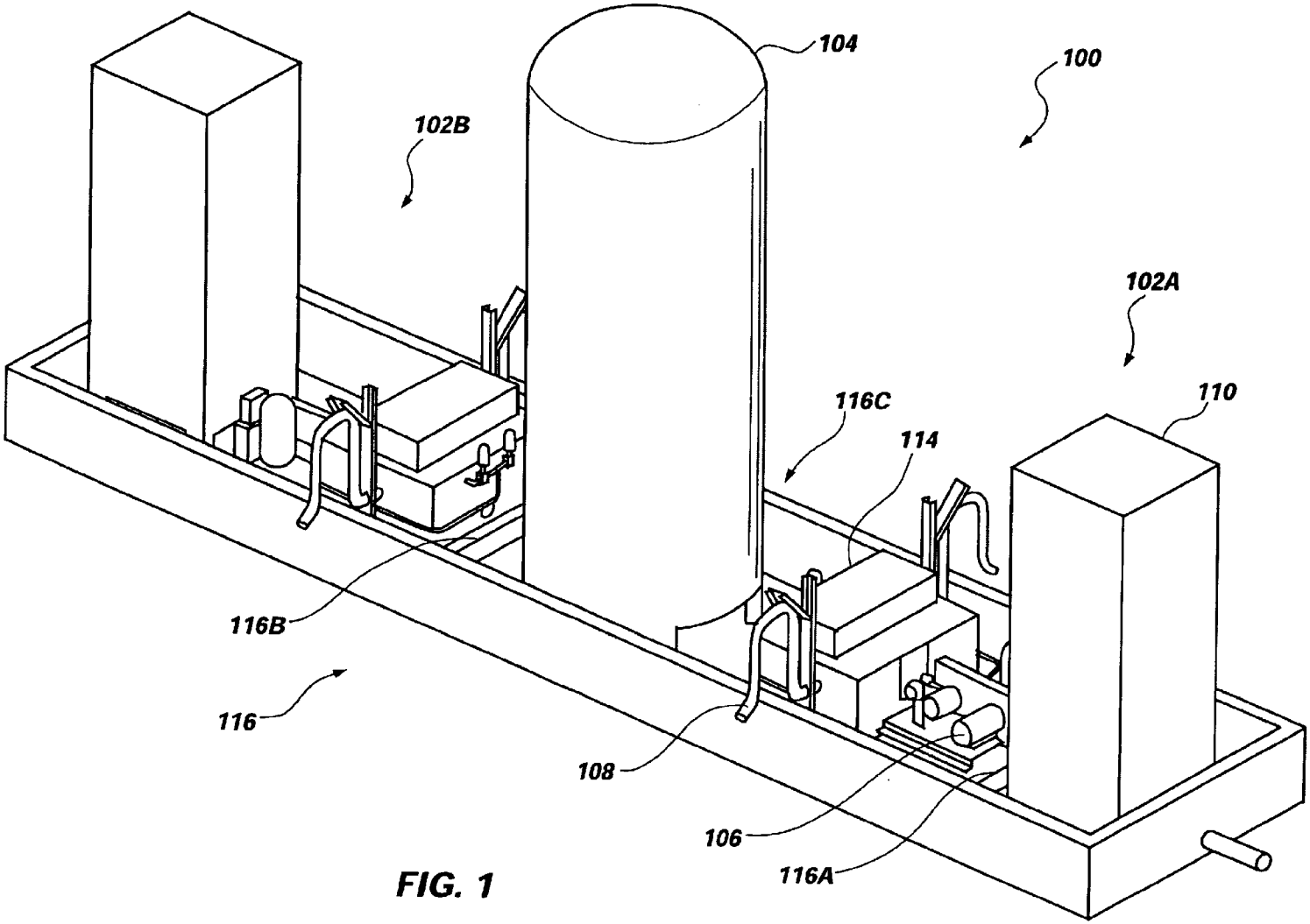
FIG. 1 is a perspective of an exemplary fueling facility according to an embodiment of the present invention.

Referring to FIG. 1, an exemplary fueling facility 100 is shown for on-demand dispensing of LNG, CNG or both. The fueling facility 100 may include one or more fueling stations 102A and 102B for dispensing fuel to, for example, a motor vehicle configured to operate through the combustion of natural gas. A storage tank 104, configured for the cryogenic storage of LNG at, for example, approximately 30 psia and under saturated conditions, supplies LNG to the fueling stations 102A and 102B. It is noted that, while 30 psia is discussed as an exemplary pressure of an LNG supply, other pressures may be acceptable, including pressures as low as 0.5 psia, so long as they are capable of providing a flow from the LNG supply (e.g., the storage tank 104) to the pump 106 as shall be described in more detail below herein. It is further noted that, while the LNG supply is referred to herein as saturated LNG, such generally refers to a liquid substantially at equilibrium under specified temperature and pressure conditions. More generally, the LNG supply is in a liquid state capable of being pumped.

With both fueling stations 102A and 102B being substantially similar in construction and operation, reference only to the components of the first fueling station 102A will be made for sake of convenience and simplicity. The storage tank 104 is coupled to the pump 106 which, depending on current demand, provides pressurized LNG to either an LNG dispensing nozzle 108 for dispensing into a vehicle's tank, or to a vaporizer 110 for conversion of the LNG to CNG through the addition of thermal energy thereto. The vaporizer 110 is coupled with a CNG outlet 112 which is coupled to a CNG dispensing device (not shown in FIG. 1) for the dispensing thereof to a vehicle's tank. In one embodiment, the CNG dispensing device may be remotely located from the fueling station (e.g., by several hundred feet or more) and coupled with the CNG outlet 112, for example, by way of underground piping. In another embodiment, the CNG dispensing device may be collocated with the fueling station 102A.

Figure 2:
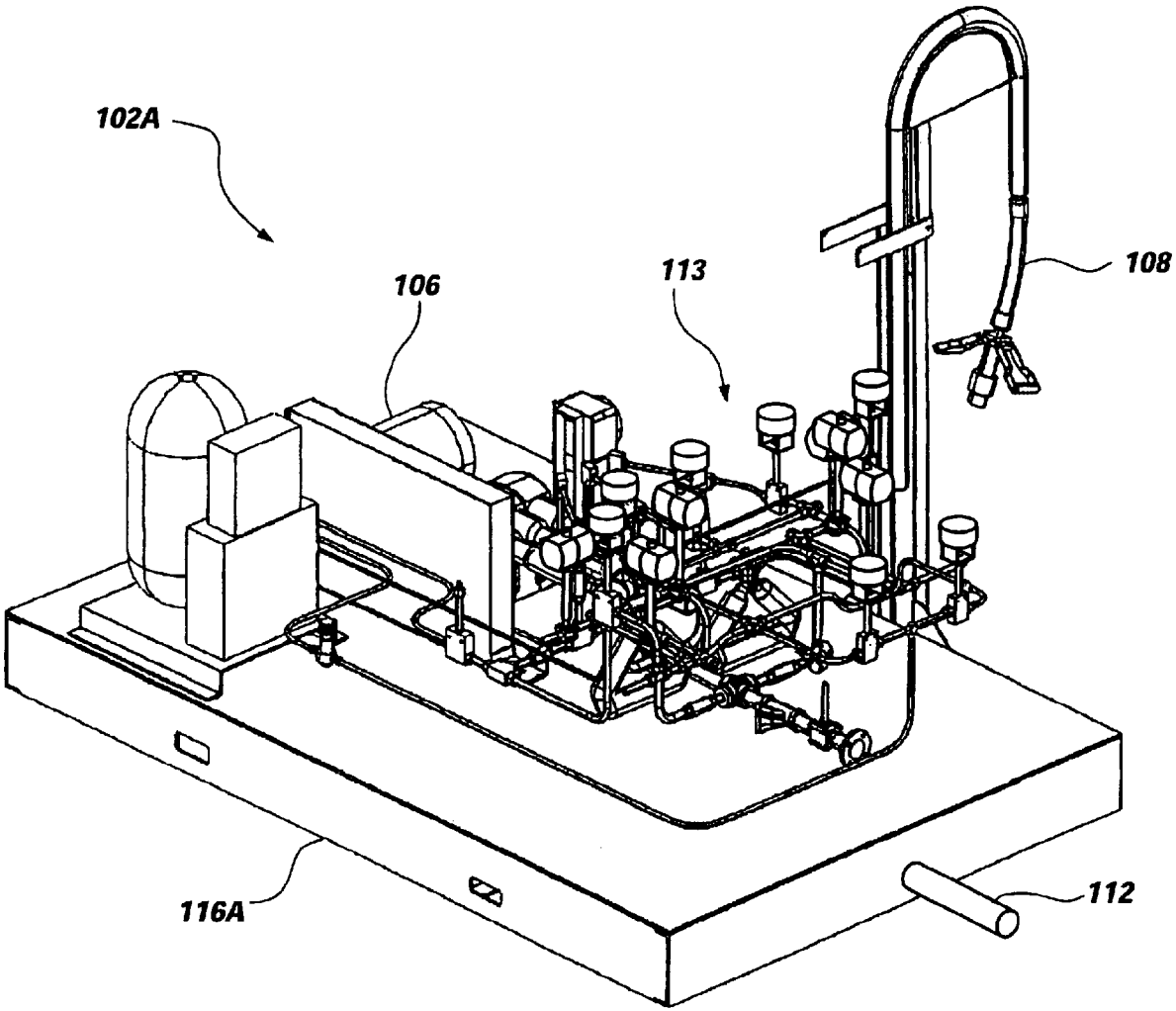
FIG. 2 is a perspective of an exemplary fueling station according to an embodiment of the present invention.
Figure 3:
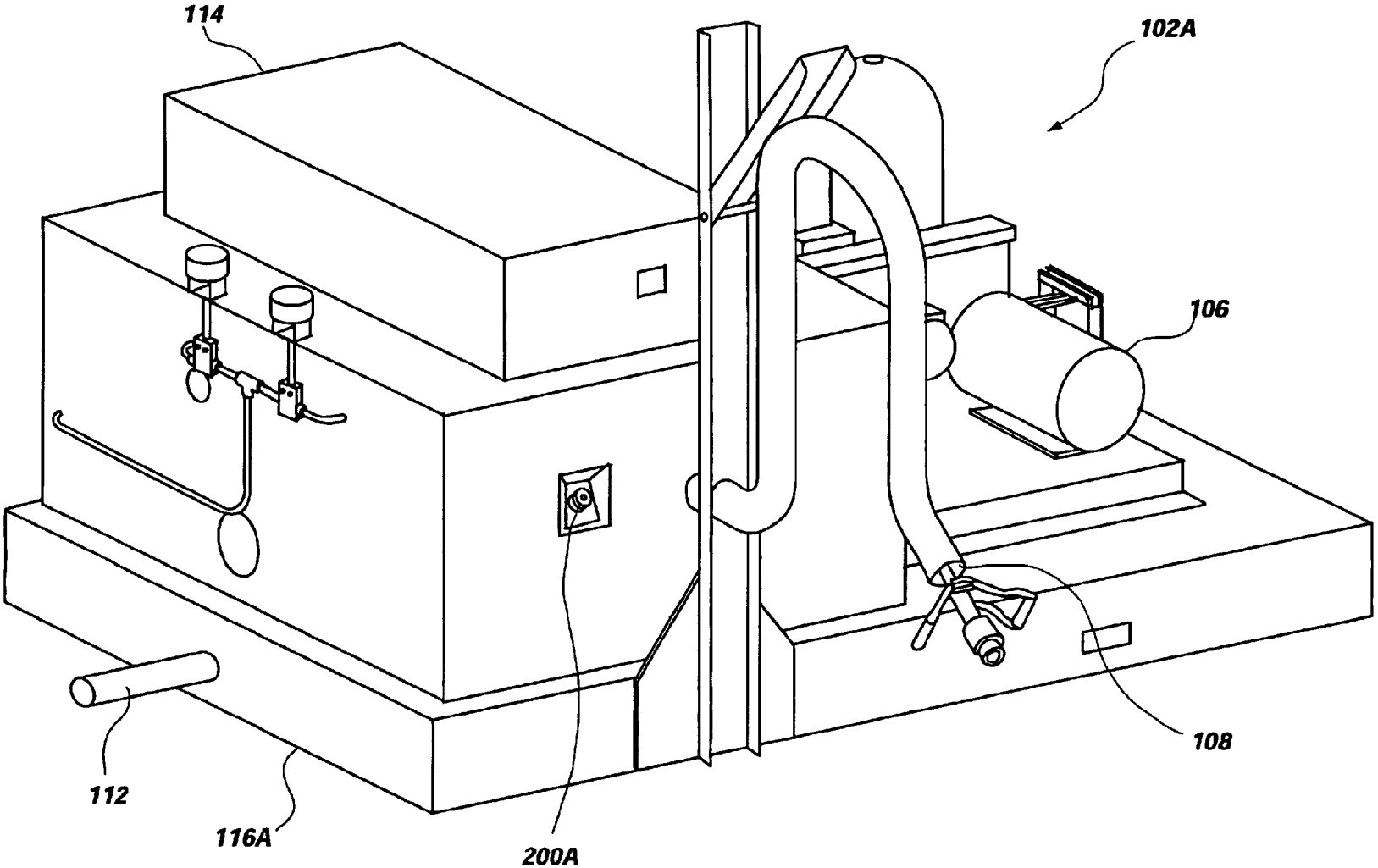
FIG. 3 is another perspective of the fueling station shown in FIG. 2.

With continued reference to FIG. 1, and also referring to FIGS. 2 and 3, which show additional perspective views of the fueling station 102A (without the vaporizer 110 and showing only one LNG dispensing nozzle 108 for purposes of clarity and convenience), various piping and associated components, denoted generally as 113 in FIG. 2, are included in the fueling station 102A and serve to interconnect various mechanical and thermodynamic components thereof. For example such piping and other components 113 may include various types of valves, flow meters, pressure regulators and runs of pipe or tubing associated with the operation of the fueling station 102A, as will be discussed in greater detail below, many of which components 113 may be housed within a cold box 114 (FIGS. 1 and 3) which is configured to thermally insulate such components from the surrounding environment. Such a configuration may include locating the discharge portion of the pump 106 within the cold box 114 while locating the portion of the pump which generates any substantial thermal energy substantially without the confines of the cold box 114.

It is noted that, while the exemplary embodiment of the present invention shows a cold box 114 housing various components, such components may each be individually insulated from the surrounding environment and from one another instead of, or in addition to, the placement of such components within a cold box 114. It is further noted that various valves, piping, tubing or other components associated with the production of CNG (such components being set forth in greater detail below herein) may also be insulated depending, for example, on the environment in which the fueling facility is placed in service.

The fueling stations 102A and 102B may be mounted on a skid 116 such that the entire fueling facility 100 may be prefabricated and then transported to a specific site. The skid 116 may be fabricated as a single unit or may include individual skids 116A and 116B each associated with individual fueling stations 102A and 102B respectively. In the exemplary embodiment shown in FIG. 1, the individual skids 116A and 116B are coupled together so as to form a containment berm 116C formed about the storage tank 104. Thus, in the embodiment shown, the storage tank 104 is not necessarily mounted on the skid 116 and is independently installed relative to the individual skids 116A and 116B. The use of skids 116A and 116B in fabricating and assembling the fuel stations 102A and 102B also enables relocation of the fueling facility 100 with relative ease if and when such relocation is desired.

It is noted that, while the exemplary fueling facility 100 is shown to include two fueling stations 102A and 102B supplied by a common storage tank of saturated LNG, other embodiments are contemplated and will be appreciated by those of ordinary skill in the art. For example, additional fueling stations may be coupled with the storage tank 104 depending, for example, on the capacity of the storage tank 104. Alternatively, the fueling facility 100 may include a single fueling station if so desired. It is also noted that while the fueling stations 102A and 102B of the exemplary fueling facility 100 are each shown to include a single LNG dispensing nozzle 108 and a single CNG outlet 112, the fueling stations 102A and 102B may employ multiple LNG nozzles 108 and/or multiple CNG outlets 112 if so desired and in order to meet anticipated demands.

Figure 4:
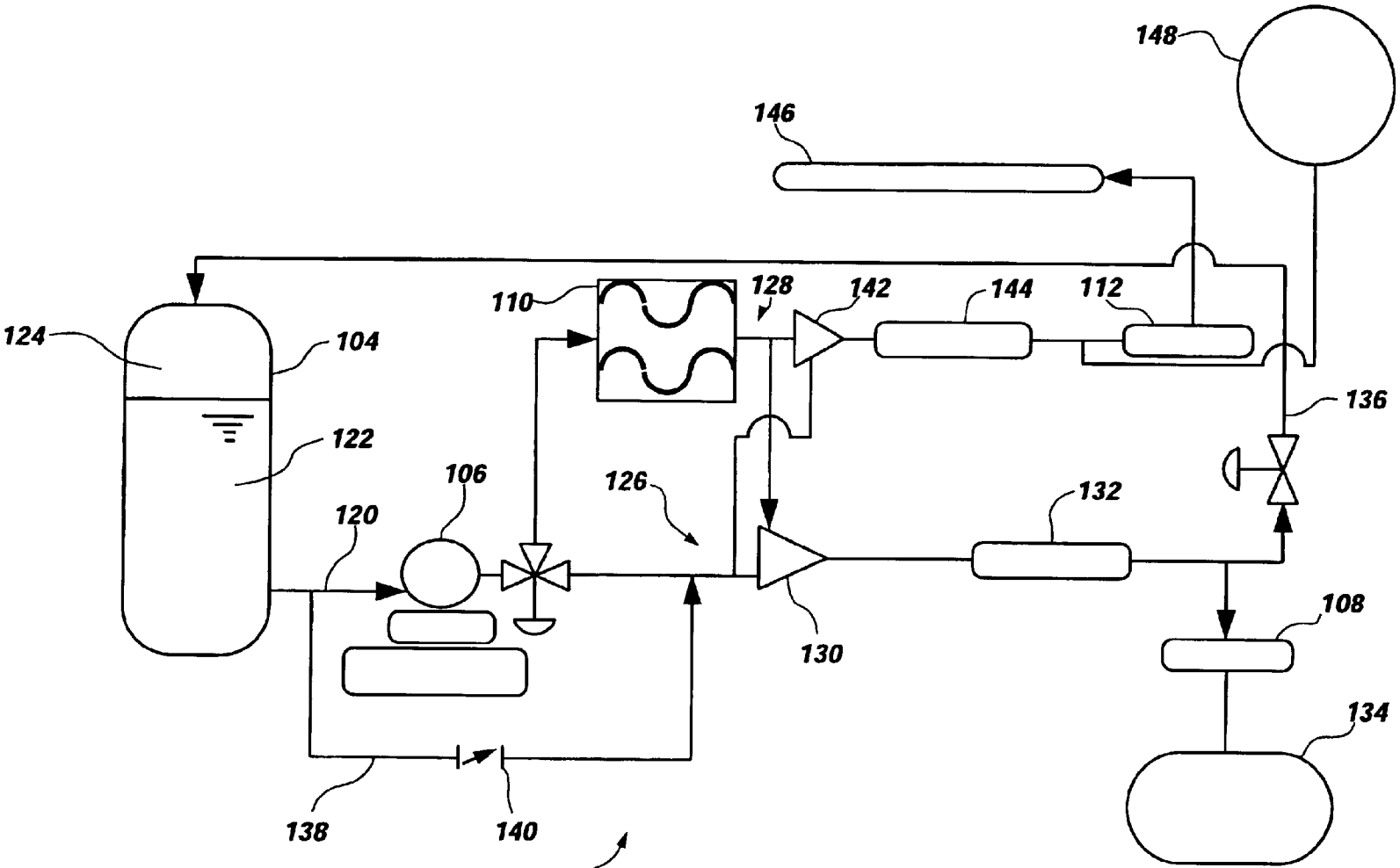
FIG. 4 is a simplified schematic of a fueling station according to an embodiment of the present invention.

Referring now to FIG. 4, a schematic of an exemplary fueling station 102A is shown. The fueling station 102A is coupled to the LNG storage tank 104 by way of a feed line 120. The storage tank 104 contains a volume 122 of saturated LNG and a volume 124 of natural gas vapor which provides a vapor head within the storage tank 104. The feed line 120 provides LNG to the pump 106 which may desirably be configured as a low-volume, high-pressure pump. As pressurized LNG exits the pump 106, depending on the fueling demands being placed on the fueling station 102A, it may flow through an LNG flow path 126 or a CNG flow path 128.

If a demand for LNG is initiated, the pressurized LNG flows from the pump 106, through a mixer 130, the function of which shall be discussed in more detail below, through a flow meter 132 and may be dispensed from an LNG dispensing nozzle 108 to a vehicle tank 134. A circulation line 136 (recirculation line) may circulate unused or excess LNG back to the storage tank 104 from the LNG flow path 126.

A bypass line 138 may be provided to enable the diversion of a volume of LNG from the feed line 120 around the pump 106 and into the LNG flow path 126 such as, for example, during start up of the pump at the initiation of a demand for LNG at the LNG dispensing nozzle 108. A check valve 140 may be placed in the bypass line 138 to prevent any pressurized LNG which may be present in the LNG flow path 126, such as from the pump 106 after start-up thereof, from flowing back to the storage tank 104 through the feed line 120.

If a demand for CNG is initiated, pressurized LNG flows from the pump 106 through the CNG flow path 128. The CNG flow path 128 includes a vaporizer 110 which transfers thermal energy to the natural gas so as to produce CNG from the pressurized LNG. CNG exits the vaporizer 110 and passes through a mixer 142, the function of which shall be described in more detail below, through a meter 144 and is dispensed to a CNG vehicle tank 146 through the CNG dispensing nozzle 112. While, if desired, the CNG produced from the LNG may be placed in an adequately rated pressure vessel 148 and stored for future dispensing into a CNG vehicle tank 146, an advantage of the present invention is that intermediate storage of CNG is not required for the fueling of CNG vehicles. Rather, the CNG may be produced and dispensed on-demand from the LNG supply. In other words, the CNG may flow substantially directly from the vaporizer 110 to the CNG outlet 112 and/or associated CNG dispensing unit. It is to be understood that "substantially directly" allows for a diversion of some of the CNG flowing from the vaporizer 110 as well as the introduction of one or more additives to the CNG flowing from the vaporizer 110. Rather, the term "substantially directly" indicates that intermediate storage is not required or utilized between the production of the CNG by the vaporizer 110 and the dispensing thereof to a vehicle's fuel tank.

Figure 5:
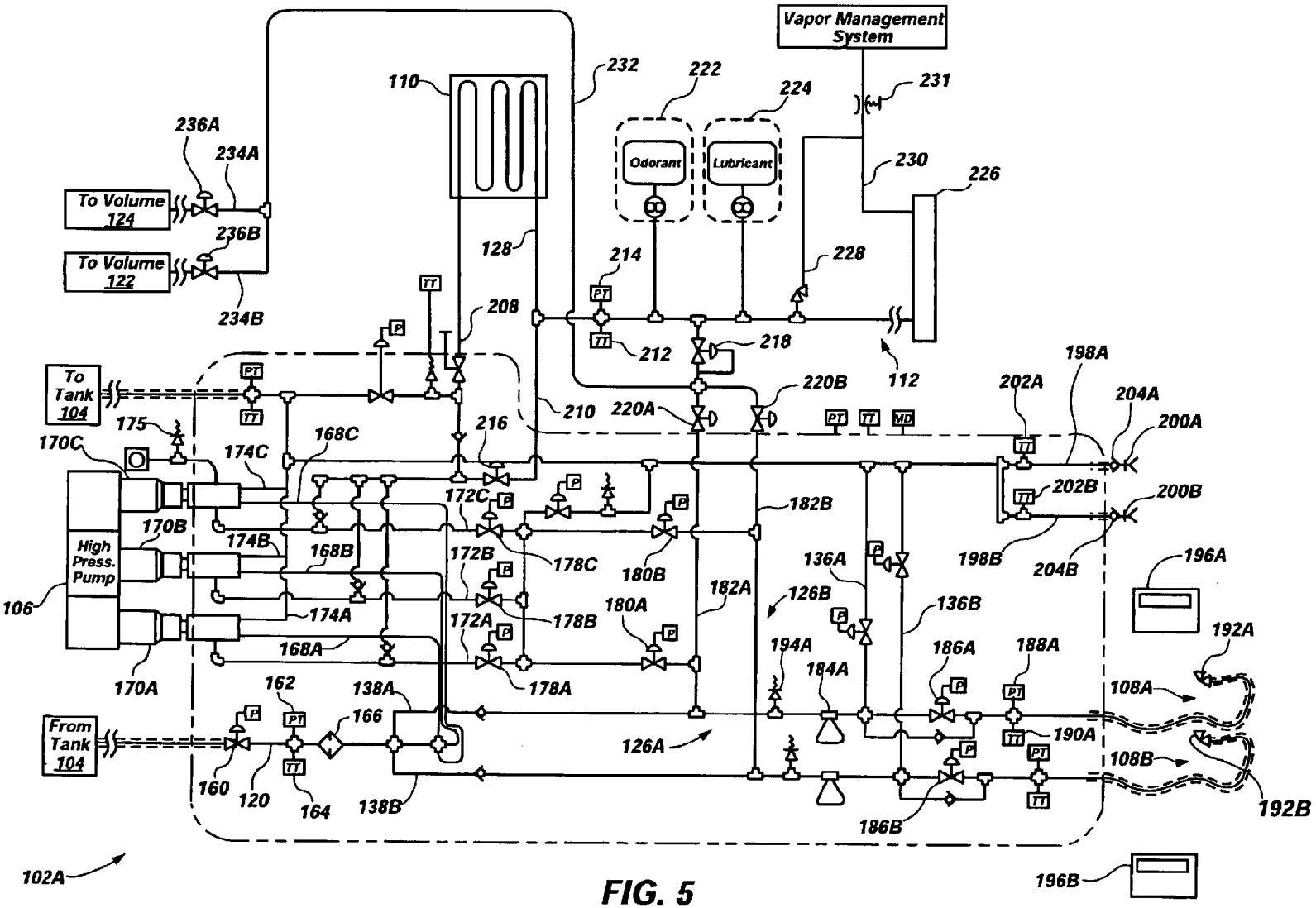
FIG. 5 is a process flow diagram of a fueling station according to an embodiment of the present invention.

Referring now to FIG. 5, a process flow diagram is shown of a fueling station 102A in greater detail. In describing the fueling station 102A depicted in FIGS. 1 and 3, various exemplary components may be set forth for use in conjunction with an exemplary embodiment of the fueling station 102A. However, as will be appreciated by those of ordinary skill in the art, other suitable components may be utilized and the scope of the present invention is in no way limited to the specific exemplary components set forth in describing the present embodiment.

As indicated above, LNG is provided from a storage tank 104 (not shown in FIG. 3) through a feed line 120. A shutoff valve 160 is positioned in the feed line to control the flow of LNG between the storage tank 104 and the fueling station 102A. In one embodiment, an exemplary shut off valve may include a normally closed 2" ball valve with a solenoid or similar actuator and rated for service at approximately 300 psia and −240° F. Other components may be coupled to the feed line 120 for monitoring various characteristics of the LNG as it passes therethrough. For example, a pressure transducer 162 and a temperature sensor 164 may be coupled to the feed line in order to monitor the pressure and temperature of the incoming LNG. Similarly, a flow meter (not shown) may be coupled to feed line 102 for determining the rate of flow of the LNG entering the fueling station 102A and/or for determining the cumulative volume of LNG entering the fueling station 102A during a given period of time. A strainer 166 may also be coupled to the feed line 120 so as to ensure the quality of the LNG which is being processed by the fueling station. 102A.

The feedline 120 may be diverted into one of two bypass lines 138A and 138B (as there are two independent LNG dispensing nozzles 108A and 108B in the presently described embodiment shown in FIG. 3) such as during a start-up phase of the fueling station 102A as will be discussed in further detail below. The feed line 120 also provides LNG to the pump 106 through a branching of three different supply lines 168A, 168B and 168C. The pump 106, as shown in FIG. 3, may include a high pressure, low volume triplex-type pump configured to pump, for example, approximately twenty-four (24) gallons per minute (gpm) (8 gpm×3 pistons) at a pressure of approximately 5,000 psia. Such a pump is commercially available from CS&P Cryogenics located in Houston, Tex.

Each of the supply lines 168A–168C is configured to supply an individual one of the three pistons 170A–170C of the triplex-type pump 106. Similarly, each of the pistons 170A–170C pumps pressurized LNG into an associated pressure line 172A–172C. Additionally, individual vent lines 174A–174C are coupled with each piston 170A–170C and provide a flow path 176 back to the tank 104 (not shown) through appropriate valving and piping. The pump may also include a pressure relief valve 175 to prevent over pressurization and potential failure of the pump 106.

The pressure lines 172A–172C provide pressurized LNG to either or both of the LNG flow paths 126A and 126B, to the CNG flow path 128, to all of the aforementioned paths simultaneously, or to any combination thereof through the appropriate control of various valves and flow control mechanisms as set forth below. Considering first the LNG side of the fueling station, pressurized LNG may flow through diverter valves 178A–178C, each of which in the exemplary embodiment may include a normally open ¾" control valve rated for service at approximately 5,000 psia and at −240° F. The pressurized LNG passes through any combination of the diverter valves 178A–178C depending on demand. Due to lack of back pressure the pressurized LNG may experience a drop in pressure to, for example, approximately 300 psia as it passes through the diverter valves 178A–178C.

It is noted that the pump 106 need not produce an elevated pressure (e.g., 5,000 psia) but, rather, may provide pressurized LNG at the pressure needed to deliver LNG to a vehicle's tank. Thus, for example, the pump 106 may produce pressurized LNG at a pressure of, for example, approximately 300 psia which, thus does not necessarily experience a reduction in pressure as it passes through the diverter valves 178A–178C. However, the pump 106 may still build up the pressure of any LNG diverted to the vaporizer 110 to a desired pressure (e.g., 5,000 psia) while providing LNG at a "reduced" pressure (as compared to that diverted to the vaporizer 110) to the LNG flow paths 126A and 126B.

In one exemplary scenario, the pump 106 may be producing LNG through the pressurized output lines 172A–172C at a pressure of approximately 300 psia. If, for example, diverter valves 178A and 178B are open and diverter valve 178C is closed, LNG flows through diverter valves 178A and 178B to the LNG flow paths 126A and 126B at a pressure of approximately 300 psia while LNG is diverted by diverter valve 178C to the vaporizer and builds to a desired pressure (e.g., 5,000 psia). In such a scenario, energy is conserved by pumping LNG at the pressure which is required to dispense LNG to a vehicle's tank, while independently building pressure of diverted LNG to a required pressure for the conversion of the LNG to CNG in the vaporizer 110.

Returning to LNG side of the fueling station 102A, any LNG exiting the diverter valves 178A–178C is then directed through either, or both, of LNG control valves 180A and 180B. LNG control valve 180A controls the supply of LNG through the first LNG flow path 126A while LNG control valve 180B controls the supply of LNG through the second LNG flow path 126B. Thus, through proper actuation of the LNG control valves 180A and 180B, the LNG may be directed to flow through a specified one of the LNG flow paths 126A and 126B or to both simultaneously. Exemplary LNG control valves 180A and 180B may include a normally closed 1" on/off control valve rated for service at approximately 300 psia and at −240° F. Such control valves 180A and 180B may also function as diverter valves depending, for example, on the operational configuration of the fueling station 102A.

As the LNG flow paths 126A and 126B are substantially similar, only one of the flow paths 126A is described in further detail for sake of convenience and simplicity in description and illustration. LNG flowing from the control valve 180A may be mixed with a defined volume of CNG from diverted CNG line 182A to control the temperature of the LNG flowing through the LNG flow path 126A. The warmed LNG then flows through a mass flow meter 184A, through another control valve 186A which may be configured similar to LNG control valves 180A and 180B, and finally through LNG dispensing nozzle 108A to a vehicle's LNG tank 134 (see FIG. 2). An exemplary dispensing nozzle 108A may include a 1" break away nozzle assembly 192A rated for service at approximately −240° F.

Sensors, such as a temperature sensor 188A and a pressure transducer 190A, may be placed in the LNG flow path close to the dispensing nozzle 108A to monitor the characteristics of LNG being dispensed and to assist in controlling the production of an dispensing of LNG. For example, the temperature of LNG within the LNG flow path 126A may be monitored to assist in controlling the flow rate of any CNG injected thereinto by way of CNG warming line 182A.

The LNG flow path may also include a pressure relief valve 194A so as to maintain the pressure in the LNG flow path 126A at or below a defined pressure level. An exemplary pressure relief valve may include a 1" pressure relief valve rated for service at approximately 300 psia and at −240° F.

A user interface and display unit 196A may be operatively coupled with the fueling station 102A such that a user may initiate demand of LNG through LNG dispensing nozzle 108A and to monitor the progress of fueling activities. Another user interface and display unit 196B may be associated with the dispensing of fuel from the LNG dispensing nozzle 108B. Similarly, while not specifically shown in FIG. 3, a user interface and display unit may be associated CNG dispensing nozzles 112 (see FIGS. 1 and 2).

Referring back to LNG flow path 126A, a circulation line 136A may be used to circulate excess LNG back to the tank 104 (see FIGS. 4 and 5) as may be required during the fueling process such as when a vehicle's LNG tank is filled to capacity or when a user otherwise terminates the fueling of a vehicle. Also, inlet receptacles 200A and 200B (see also FIG. 3) are provided, for example, for coupling with a vehicle's LNG tank during fueling. The receptacles 200A and 200B are coupled with the recirculation lines 198A and 198B to provide a flow path back to the storage tank 104 (see FIGS. 1 and 2) from a vehicle's tank or tanks as will be appreciated by those of ordinary skill in the art. Such receptacles 200A and 200B may also be coupled with the dispensing nozzles 108A and 108B during periods when vehicles are not being refueled. Such coupling of the dispensing nozzles 108A and 108B with the inlet receptacles 200A and 200B may provide for recirculation of LNG and, thus, cool various components of the fueling station 102A as well as the LNG flowing through such components.

It is noted that the fueling station may be configured to utilized one of various techniques. For example, when not dispensing LNG fuel to a vehicle's tank, the pump 106 may continue produce a pressurized output and the output may be circulated through the LNG flow paths 126A and 126B such as described above herein. Either or both of the LNG dispensing units 108A and 108B may be coupled with an associated inlet receptacle 200A and 200B to circulate LNG through the associated recirculation lines 198A and 198B and, ultimately, back to the tank 104. Since substantially continuous circulation of LNG through the dispensing units 108A and 108B and associated inlet receptacles 200A and 200B may cause the LNG nozzles 192A and 192B to freeze up after a period of time, control valves 186A and 186B may be used to stop flow through the dispensing units 108A and 108B and circulate the LNG back through circulation lines 136A and 136B respectively.

It is additionally noted that, the fueling station 102A may be configured for passive cooling, meaning that the pump 106 need not be operated to in order to circulate LNG through the LNG flow paths 126A and 126B. For example, the elevation head of the LNG supply (e.g., within the LNG tank 104) may be sufficient to cause LNG to flow through the supply lines 168A–168C and through a bypass associated with each piston 170A–170C of the pump 106. Any LNG flowing through the bypass of the pump 106 would then flow through the LNG paths 126A and 126B and subsequently circulate, for example, through circulation lines 136A and 136B back to the tank. Thus, the present invention may take advantage of the head of the LNG supply to render passive cooling to the various component of the fueling station 102A without the need to expend energy in the operation of the pump 106.

Still referring to FIG. 5, sensors, such as, for example, temperature sensors 202A and 202B, for determining characteristics of the incoming or recirculated LNG may also be provided in association with the inlet receptacles 200A and 200B as may be desired. Additionally, check valves 204A and 204B may be provided to ensure that LNG already present in the circulation lines 136A and 36B does not inadvertently flow backwards into a vehicle's LNG tank or tanks.

It is noted that the configuration of the fueling station 102A and, more particularly, the LNG flow path, enables LNG to be provided at a vehicle's LNG tank at a relatively high pressure of up to, for example, approximately 300 psia and at a relatively cold temperature of, for example, −240° F. Significantly, this enables the collapsing of an existing vapor head formed within a vehicle's LNG tank rather than requiring the purging of any vapor within the vehicle's LNG tank prior to introducing the LNG therein.

Referring back to the bypass lines 138A and 138B, LNG provided from the storage tank 104 (see FIGS. 1 and 4) is allowed to enter the LNG flow paths 126A and 126B providing what may be termed flood fuel at the start up of a fueling station 102A. The flood fuel ensures that LNG, rather than gas or vapor, is present in the LNG flow paths 126A and 126B prior to fuel being supplied by the pump at elevated pressures (e.g., 300 psia) which might otherwise result in surge bangs within piping which defines the LNG fuel paths 126A and 126B.

Still referring to FIG. 5, the CNG side of the fueling station is now considered. Starting at pressure lines 172A–172C as they exit the pump 106, if any or all of the LNG control valves 178A–178C are in the closed position (or at least partially closed), at least a portion of the pressurized LNG will flow into the CNG flow path 128. For example, if control valve 178C is in a closed position, the LNG associated with pressure line 172C will flow to the vaporizer 110 as indicated by LNG diversion line 208. Thus, pressurized LNG (e.g., approximately 5,000 psia) may be introduced into the vaporizer 110 which transfers thermal energy to the LNG for the conversion of LNG into CNG. An exemplary vaporizer 110 may include an ambient forced air vaporizer 110 having the capacity to admit LNG at a flow rate of up to 24 gpm, at a pressure of approximately 5,000 psia and at a temperature of approximately −240° F. The vaporizer 110 may be configured to convert the LNG to CNG which exits therefrom at a relatively elevated temperature of, for example, approximately ±10° F. of the ambient temperature, at pressure of up to approximately 5,000 psia and at a flow rate of up to approximately 1,600 standard cubic feet per minute (scfm). Such an exemplary vaporizer is commercially available from Thermax Incorporated of Dartmouth, Mass. It is noted that such values of temperature, pressure and volumetric flow rater are exemplary and that the may be scaled up or down depending, for example, on the size and capacity of the pump 106 and the configuration of the associated piping.

A small amount of LNG, which is supplied through an LNG cooling line 210, may be mixed with CNG leaving the vaporizer 110 to lower the temperature thereof. In one embodiment, for example, as much as four (4) gpm may diverted through the cooling line 210 for mixture with the CNG to control the temperature thereof. Sensors, such as a temperature sensor 212 and/or a pressure transducer 214, may be positioned in the CNG flow path 128 to monitor characteristics of the CNG flowing therethrough and to assist, for example, in controlling the amount of LNG being mixed with the CNG exiting the vaporizer. The amount of LNG being mixed with CNG may be controlled by a control valve 216 such as, for example, a ½" normally closed control valve rated for service at approximately 5,000 psia.

As noted above, a portion of CNG may similarly be diverted to warm LNG prior to the dispensing thereof. In diverting a portion of CNG, a pilot controlled pressure regulating valve 218 may be used to reduce the pressure of the CNG prior to its mixing with LNG. An exemplary pressure regulating valve 218 may be configured to reduce the pressure of the CNG from approximately 5,000 psia to approximately 300 psia with a flow rate capacity of approximately 800 scfm. After a portion of CNG is directed through the pressure regulating valve 218, the reduced pressure CNG may be split into two warming lines 182A and 182B for warming LNG in LNG flow paths 126A and 126B respectively. Control valves 220A and 220B may be used to distribute and otherwise control the flow of reduced pressure CNG to the warming lines 182A and 182B. Exemplary control valves may include a ¾" normally closed proportional control valves rated for service at a pressure of approximately 300 psia and at a temperature of −240° F.

Various additives may be also introduced into, and mixed with, the CNG as it flows through the CNG flow path 128. For example, upstream of the branch containing the pressure regulating control valve 218, a source of odorant 222 may be coupled with the CNG flow path 128 to introduce and mix odorant therewith. The odorant may be added to the CNG to assist in the detection of any CNG which may leak from a vehicle's CNG tank, piping, engine or from some other storage vessel.

A source of lubricant 224 may also be coupled with the CNG flow path 128 to introduce and mix lubricant therewith. The lubricant may be added to the CNG for purposes of lubricating various motor vehicle components during processing and combustion of the gas. For example, the lubricant may be added to provide necessary lubrication of an injection device or similar fuel delivery system associated with a motor vehicle consuming and combusting CNG as will be appreciated by those of ordinary skill in the art.

The CNG flow path 128 carries CNG to a CNG dispensing unit 226 which may be coupled to a CNG outlet 112 and is configured for dispensing of the CNG fuel into a vehicle's CNG tank. The CNG dispensing unit 226 may include, for example, a 1000 or 5000 Series Dispenser or a 5000 Series Fleet Dispenser commercially available from ANGI Industrial LLC, of Milton, Wis. Such exemplary CNG dispensing units may include integrated filters, multiple dispensing hoses or nozzles, and have integrated controllers associated therewith. Such dispensers may be configured to accommodate a flow rate substantially equivalent to, or greater than, the output of the vaporizer 110.

As discussed above, while not necessary with the present invention, CNG may also be dispensed to a storage facility 148 (see FIG. 2) if so desired. While not shown in FIG. 3, a user interface and display may be operatively coupled with the fueling station 102A so that a user may initiate requests and monitor the progress of the CNG fueling activities.

A vapor bleed line 228 is coupled to the CNG path 128 and is further coupled with a vapor return line 230. The vapor return line 230 is configured to receive any vapor bled off from the CNG dispensing unit 226, which may include vapor bled off a vehicle's CNG tank and fed back through the CNG dispensing unit. Vapor drawn off from these two lines 228 and 230 may be combined and through a pressure regulator 231 fed to a vapor management system which may include, for example, circulation back into the storage tank 104 (FIGS. 1 and 4). An exemplary pressure reducing valve 231 may be configured to reduce the pressure of vapor from approximately 5,000 psia to approximately 25 psia.

Further examples of an appropriate vapor management system may include for example, metering the gas back into a residential grid, use of the gas as a fuel for on site heating needs, further compression of the gas for use as vehicle fuel, or simply venting of the gas to the atmosphere as allowed by applicable regulations.

As set forth above, LNG may be circulated back to the storage tank 104 (see FIGS. 1 and 2) from various points along the LNG flow path 126. Similarly, CNG may be circulated back to the tank 104 from the CNG flow path 128. For example, CNG circulation line 232 may be configured to draw CNG from a location downstream of the pressure regulating control valve 218, and prior to its mixture with LNG, to circulate the CNG back to the storage tank 104 (see FIGS. 1 and 2) and, more particularly, into either the vapor containing volume 124 (see FIG. 2), as indicated at line 234A, or to the LNG containing volume 122 (see FIG. 2), as indicated at line 234B. Control valves 236A and 236B may be used to control the flow of CNG back to the storage tank 104. Exemplary control valves may include a ¾" normally closed ball valve rated for service at approximately 300 psia and at a flow rate of approximately 720 scfm.

While the example set forth in FIG. 5 illustrates a multiplexing arrangement which utilizes a multiplex pump 106 and diverter valves 178A–178C associated with the individual pistons of the pump 106, other multiplexing arrangements may also be utilized. Such multiplexing arrangements may include, for example, those shown in FIGS. 6A through 6E.

Figure 6A:
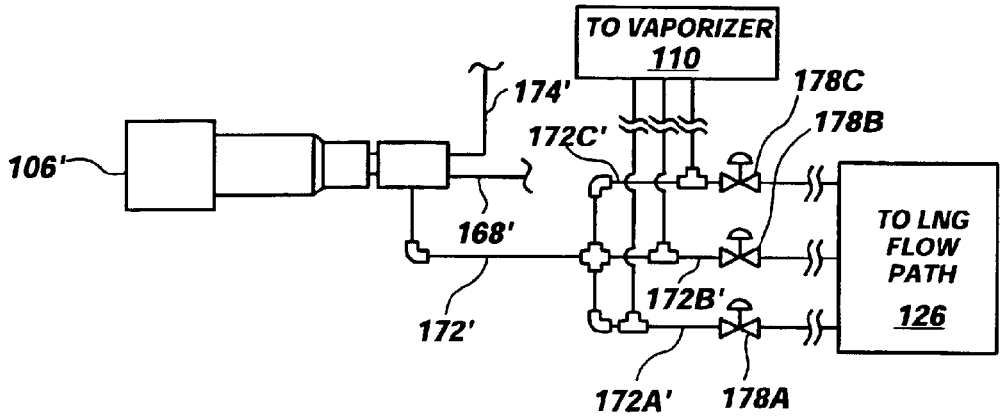
FIGS. 6A through 6E are diagrams of potential multiplexing arrangements in accordance with various embodiments of the present invention.

Referring first to FIG. 6A, a single piston pump 106' (or possibly an individual piston of a multiplex pump) may be coupled to an associated supply line 168' and vent line 174' in a manner similar to that described above. The pressure line 172' fed by the pump 106' may branch into a plurality of individual pressure lines 172A'–172C' each being associated with diverter valves 178A–178C. The diverter valves 178A–178C may then selectively direct the pressurized LNG to the vaporizer 110 or to the LNG flow path 126 in a manner consistent with that described and set forth with respect to FIG. 5.

Figure 6B:
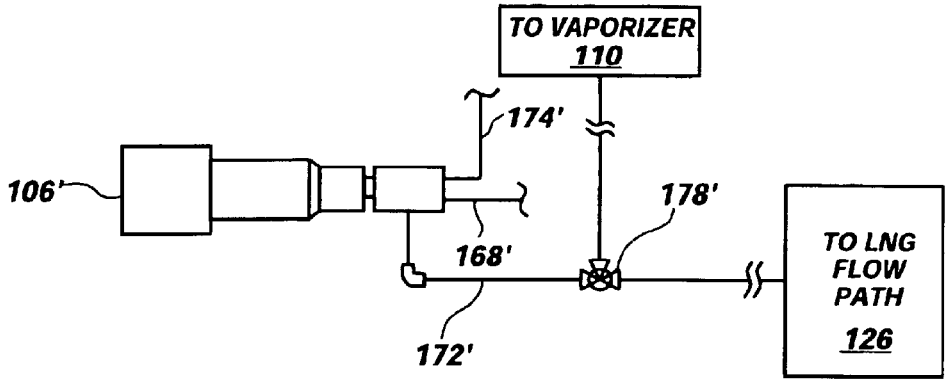

Referring to FIG. 6B, a single piston pump 106' is coupled to an associated supply line 168', pressure line 172' and vent line 174' in a manner similar to that which has previously been described herein. The pressure line 172' may be coupled to a proportional directional diverter valve 178' which proportionally diverts the pressurized LNG between the vaporizer 110 and the LNG flow path 126 (see FIG. 5) in a controlled manner. In other words, the proportional directional diverter valve 178' may incrementally control the flow of the pressurized LNG between the vaporizer 110 (FIG. 5) and the LNG flow path 126 (FIG. 5) such that all of the pressurized LNG may flow in either direction, or any desired combination of flow (e.g., 70% in one direction and 30% in the other direction) may be achieved.

Figure 6C:
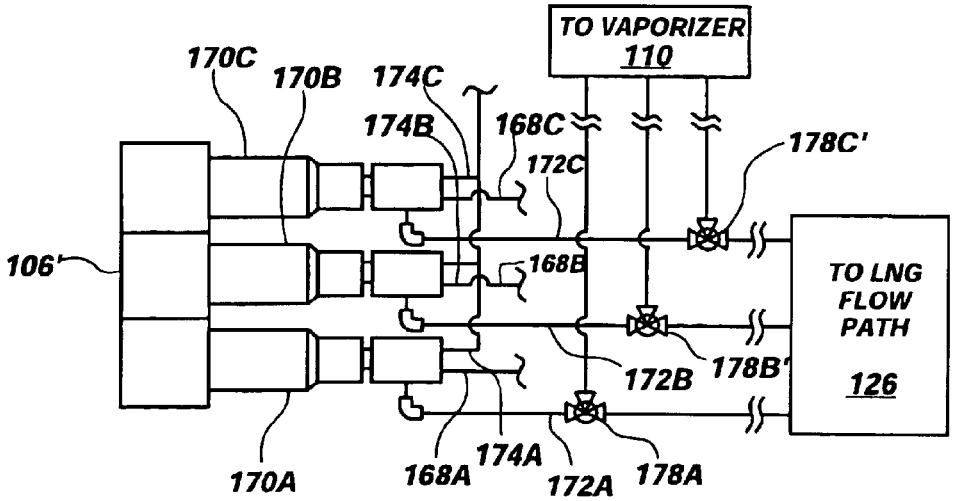

Referring to FIG. 6C, each piston 170A–170C of a multiplex pump 106 is coupled to a corresponding supply line 168A–168C, pressure line 172A–172C and vent line 174A–174C, respectively, such as set forth with respect to FIG. 5 above herein. Each individual pressure line 172A–172C is independently coupled with an associated proportional directional diverter valve 178A'–178C' respectively. Thus, the diverter valves 178A'–178C' each individually control the flow of pressurized LNG from their respective pistons 170A–170C between the vaporizer 110 and the LNG flow path 126 in a manner consistent with that described and set forth with respect to FIG. 5.

Figure 6D:
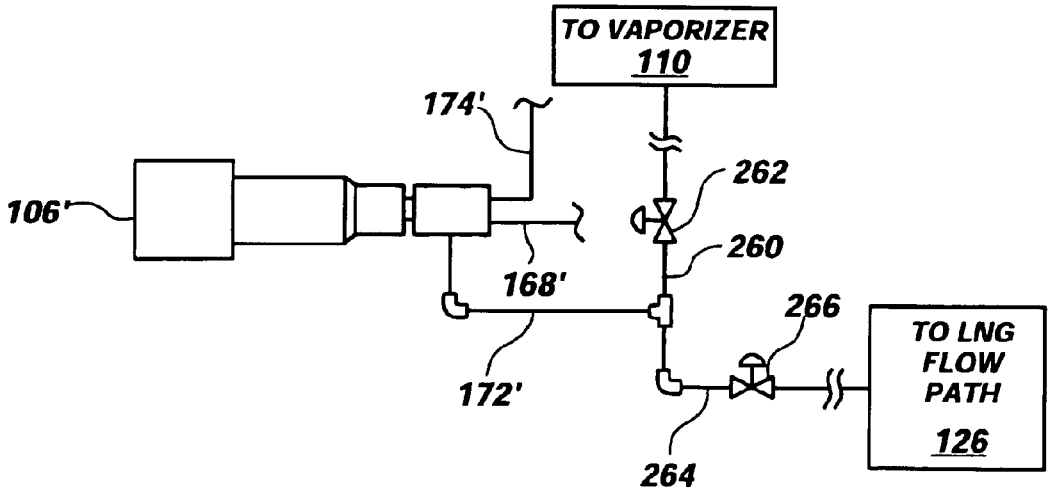

Referring to FIG. 6D, a single piston pump 106' is coupled to an associated supply line 168', pressure line 172' and vent line 174' such as previously described herein. The pressure line 172' may be may be split such that a first branch 260 flows to a first proportional control valve 262 and a second branch 264 flows to a second proportional control valve 266. The first and second proportional control valves 262 and 266 in combination control flow of pressurized LNG from the pressure line 172' to the vaporizer 110 and the LNG flow path in a manner consistent with that described and set forth with respect to FIG. 5.

Figure 6E:
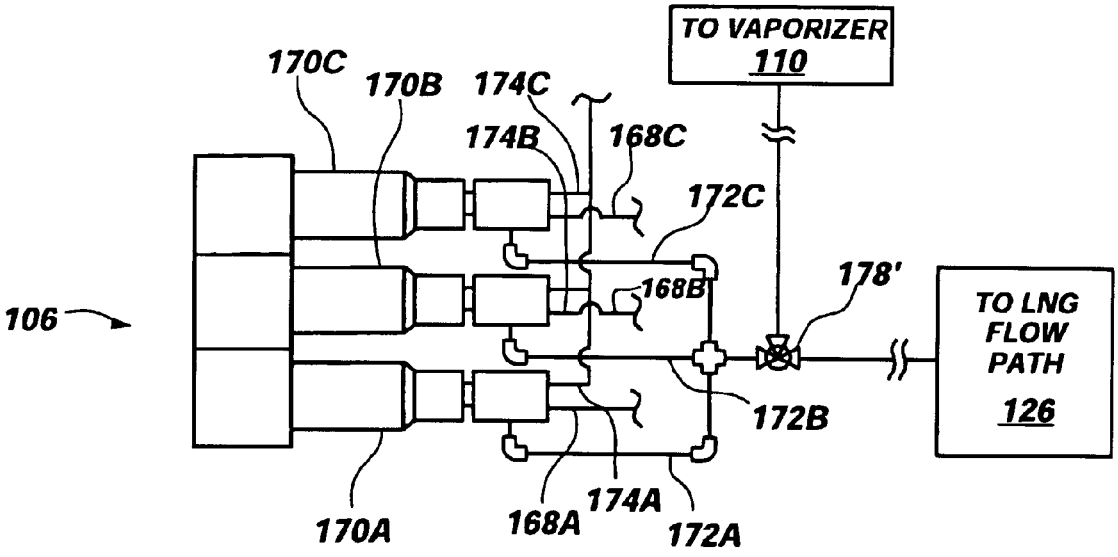

Referring now to FIG. 6E, each piston 170A–170C of a multiplex pump 106 is coupled to a corresponding supply line 168A–168C, pressure line 172A–172C and vent line 174A–174C, respectively, such as set forth with respect to FIG. 5 above herein. The individual pressure lines 172A–172C are combined into a common pressure line 270 which feeds into a proportional directional diverter valve 178'. The proportional diverter valve 178' diverts the pressurized LNG between the vaporizer 110 and the LNG flow path 126 (see FIG. 5) in a controlled manner such as described above herein.

With any of the above exemplary embodiments, the flow of the pressurized LNG is multiplexed in the sense that it is capable of being diverted between the vaporizer 110 (and associated CNG flow path 128) and the LNG flow path 126 including the ability to divert substantially all of the pressurized LNG to either destination, as well as the ability to fractionally divide the flow of the pressurized LNG between the two destinations in substantially any desired combination (e.g., 70% vaporizer/30% LNG flow path; 40% vaporizer/60% LNG flow path; etc.).

The configuration of the exemplary fueling station 102A as illustrated in FIGS. 1 through 6E offers various advantages over conventional prior art fueling stations and, further, provides considerable flexibility in the dispensing of LNG, CNG or both depending upon instant demand from a user. For example, the use of multiplexing, whether effected by a multiplex pump or through the appropriate configuration of valves and piping, enables the fueling station to provide substantially all of the output of pressurized LNG from the pump to either of the LNG flow paths 126A and 126B, to the CNG flow path 128, or to divide the output of pressurized LNG among the various flow paths depending upon demand. If only LNG is desired, pressurized LNG may flow through pressure lines 172A–172C, through diverter valves 178A–178C, and into either or both LNG flow paths 126A and 126B as required by proper actuation of control valves 180A and 180B.

If the substantially simultaneous dispensing of both CNG and LNG is required, then a portion of the pressurized LNG is diverted through LNG diversion line 208. For example, one or more diverter valves 178A–178C may be closed, or partially closed, to cause pressurized LNG to flow through LNG diversion line 208 rather than to the control valves 180A and 180B and the corresponding LNG flow paths 126A and 126B. The pressurized LNG may then pass through the vaporizer 110 for production of CNG as set forth above herein.

If only CNG is desired, substantially all of the pressurized LNG may be diverted through LNG diversion line 208 by appropriate actuation of diverter valves 178A–178C to produce a greater volume of CNG. It is noted, that the phrase "substantially all" is used above in discussing the flow of pressurized LNG when the dispensing of either only LNG or only CNG is desired. It is to be understood that the use of the term "substantially all" recognizes that a small amount of pressurized LNG may be diverted off for purposes of temperature control. For example, if only the dispensing of LNG is required, a small volume of pressurized LNG may be diverted through the vaporizer 110 to be injected into, and mixed with, the LNG through CNG warming lines 182A and 182B if so required.

The fueling station 102A of the present invention further enables the dispensing of natural gas fuel in a thermally and cost efficient manner. For example, the integrated dispensing of LNG and CNG maintains the LNG in a relatively cold state and helps to avoid cool down runs as required in conventional fueling stations wherein cold LNG must be circulated through the system for a period of time in order to cool down the various components prior to dispensing the fuel into a vehicle's tank. Moreover, such a configuration provides passive cooling with an open supply of LNG through the pump 106 which may be circulated back to the tank 104 (FIGS. 1 and 2). Such a configuration enables effectual instant, or on-demand, delivery of fuel.

Additionally, it has been estimated that the production and dispensing of CNG in accordance with the present invention provides as much as 20 to 1 savings as compared to the conventional production, transportation, storage and ultimate dispensing of CNG to motor vehicles for combustion thereby.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A fueling station comprising:

at least one pump configured to boost a pressure of a volume of liquefied natural gas (LNG) supplied thereto, the at least one pump having at least one pressurized output configured to supply pressurized LNG;

at least one diverter valve operably coupled to the at least one pressurized output of the at least one pump, wherein the at least one diverter valve is configured to selectively divert the flow of any pressurized LNG flowing from the at least one pressurized output of the at least one pump between a first flow path and a second flow path;

at least one LNG dispensing unit in fluid communication with the first flow path;

a vaporizer in fluid communication with the second flow path, the vaporizer being configured to receive and convert pressurized LNG to compressed natural gas (CNG); and at least one CNG dispensing unit in fluid communication with the vaporizer.

2. The fueling station of claim 1, further comprising at least one pressure reducing apparatus positioned in fluid communication with the first flow path between the at least one diverter valve and the at least one LNG dispensing unit.

3. The fueling station of claim 1, wherein the at least one pump includes at least one multiplex pump having a plurality pistons, wherein the at least one pressurized output includes a pressurized output associated with each piston of the plurality.

4. The fueling station of claim 3, wherein the at least one diverter valve includes a plurality of diverter valves, each diverter valve of the plurality being operably coupled to the pressurized output of at least one piston of the plurality of pistons.

5. The fueling station of claim 1, wherein the at least one diverter valve includes a plurality of diverter valves, each diverter valve being operably coupled to the at least one pressurized output of the at least one pump.

6. The fueling station of claim 1, wherein the at least one diverter valve includes a first diverter valve operably coupled with the first flow path and a second diverter valve operably coupled with the second flow path.

7. The fueling station of claim 1, further comprising a warming line configured to draw a portion of CNG produced by the vaporizer and to inject the portion of CNG into the first flow path.

8. The fueling station of claim 7, further comprising a pressure regulating valve operably coupled to the warming line, the pressure regulating valve being configured to reduce a pressure of the portion of CNG prior to its injection into the first flow path.

9. The fueling station of claim 8, wherein the pressure regulating valve includes a pilot-controlled pressure regulating valve.

10. The fueling station of claim 8, further comprising a first control valve operably coupled to the warming line downstream of the pressure regulating valve and configured to selectively control a flow rate of the portion of CNG injected into the first flow path.

11. The fueling station of claim 10, further comprising a cooling line configured to draw a portion of pressurized LNG from the at least one pressurized output and to inject the portion of pressurized LNG into a CNG flow path between the vaporizer and the CNG dispensing unit.

12. The fueling station of claim 11, further comprising a second control valve operably coupled to the cooling line and configured to selectively control a flow rate of the portion of pressurized LNG into the CNG flow path.

13. The fueling station of claim 12, further comprising a cold box to house and partially insulate the at least one diverter valve, the first flow path and at least a portion of the warming line.

14. The fueling station of claim 13, wherein a first portion of the at least one pump including the at least one pressurized output is located substantially inside the cold box.

15. The fueling station of claim 14, further comprising a skid wherein the at least one pump, the vaporizer and the cold box are mounted to the skid.

16. A method of dispensing natural gas fuel comprising:

providing a supply of saturated liquified natural gas (LNG) at a first relatively low pressure to a pump;

flowing the LNG through a pump and increasing the pressure of the LNG to a second relatively high pressure;

providing a first flow path between the pump and an LNG dispensing unit;

providing a second flow path between the pump and a compressed natural gas (CNG) dispensing unit;

selectively flowing the LNG through the first flow path, the second flow path or through both the first and the second flow paths;

reducing the pressure of any LNG flowing through the first flow path to a third intermediate pressure lower than the second pressure and higher than the first pressure and dispensing at least a portion thereof through the LNG dispensing unit; and vaporizing any LNG flowing through the second flow path to produce CNG therefrom and dispensing at least a portion of the CNG through the CNG dispensing unit.

17. The method according to claim 16 further comprising drawing a portion of the CNG from second flow path and introducing it into the first flow path.

18. The method according to claim 17, further comprising monitoring the temperature of any LNG flowing through the first flow path and selectively controlling a flow rate of the portion of the CNG introduced from the second flow path to the first flow path.

19. The method according to claim 18, further comprising introducing a volume of LNG into the second flow path to cool any CNG flowing therethrough.

20. The method according to claim 19, further comprising monitoring the temperature of any CNG flowing through the second flow path and controlling the flow rate of the volume of LNG introduced into the second flow path.

21. The method according to claim 20, further comprising introducing an additive into the second flow path.

22. The method according to claim 21, wherein introducing an additive into the second flow path includes introducing an odorant into the second flow path.

23. The method according to claim 21, wherein introducing an additive into the second flow path includes introducing a lubricant into the second flow path.

24. The method according to claim 20, further comprising flowing at least a portion of any LNG in the first flow path back to the supply of LNG.

25. The method according to claim 24, further comprising flowing at least a portion of any CNG in the second flow path back to the supply of LNG.

26. The method according to claim 25, wherein vaporizing any LNG flowing along the second flow path to produce CNG therefrom includes flowing LNG through an ambient forced-air vaporizer.

27. The method according to claim 26, further comprising insulating at least a portion of the first flow path from an ambient temperature.

28. The method according to claim 27, further comprising flowing a portion of LNG directly from the supply of LNG to the first flow path prior to selectively flowing the LNG through the first flow path, through the second flow path or through both the first and the second flow paths.

29. The method according to claim 16, wherein the first pressure is as great as approximately 30 pounds per square inch absolute (psia), the second pressure is as great as approximately 5,000 psia and the third pressure is as great as approximately 300 psia.

30. The method according to claim 16, wherein vaporizing any LNG flowing through the second flow path to produce CNG therefrom and dispensing at least a portion of the CNG through the CNG dispensing unit further comprises flowing the at least a portion of the CNG from the vaporizer substantially directly to the CNG dispensing unit.

31. A method of dispensing natural gas fuel comprising:

providing a supply of saturated liquified natural gas (LNG) at a first relatively low pressure to a pump;

flowing the LNG through a pump and increasing the pressure of the LNG to a second pressure greater than the first relatively low pressure;

providing a first flow path between the pump and an LNG dispensing unit;

providing a second flow path between the pump and a compressed natural gas (CNG) dispensing unit;

selectively flowing the LNG through the first flow path, the second flow path or through both the first and the second flow paths wherein, selectively flowing the LNG through the first flow path includes selectively flowing LNG through the first flow path substantially at the second pressure, and wherein selectively flowing LNG through the second flow path includes increasing the pressure of any LNG flowing through the second path to a third pressure greater than the second pressure; and dispensing at least a portion of any LNG flowing through the first flow path through the LNG dispensing unit; and vaporizing any LNG flowing through the second flow path to produce CNG therefrom and dispensing at least a portion of the CNG through the CNG dispensing unit.

* * * * *